US005430350A

United States Patent [19]

Chen et al.

[11] Patent Number: 5,430,350

[45] Date of Patent: Jul. 4, 1995

[54] ELECTRON GUN SUPPORT AND POSITIONING ARRANGEMENT IN A CRT

[75] Inventors: Kuo-Cheng Chen, San-Chung City; Chun-Hsien Yeh; Der-Jyh Chang, both of Taipei, all of Taiwan

[73] Assignee: Chunghwa Picture Tubes, Ltd., Taoyuan, Taiwan

[21] Appl. No.: 208,128

[22] Filed: Mar. 9, 1994

[51] Int. Cl.[6] ..... H01J 29/82

[52] U.S. Cl. ..... 313/417; 313/240; 313/456; 313/479; 313/482; 313/558; 313/559

[58] Field of Search ..... 313/417, 425, 451, 456, 313/558, 559, 242, 244, 252, 284, 292, 479, 482, 240

[56] References Cited

U.S. PATENT DOCUMENTS

| | | | |
|---|---|---|---|
| 3,909,655 | 9/1975 | Grimmett et al. | 313/451 X |
| 4,100,453 | 7/1978 | van den Einden | 313/417 |
| 4,119,885 | 10/1978 | Stover | 313/479 |
| 4,344,015 | 8/1982 | Marschka | 313/479 X |
| 4,366,415 | 12/1982 | Takenaka et al. | 313/457 |
| 4,471,264 | 9/1984 | Matsuzaki et al. | 313/479 X |
| 4,479,073 | 10/1984 | Van Daelen | 313/451 |
| 4,609,848 | 9/1986 | Takenobu | 313/417 |
| 4,665,340 | 5/1987 | Odenthal et al. | 313/449 |
| 4,713,578 | 12/1987 | Josephs | 313/558 X |
| 5,150,002 | 9/1992 | Van der Hoeck et al. | 313/417 |

*Primary Examiner*—Sandra L. O'Shea
*Assistant Examiner*—Ashok Patel
*Attorney, Agent, or Firm*—Emrich & Dithmar

[57] ABSTRACT

In a cathode ray tube (CRT) having a glass envelope with a neck portion, a funnel portion and a display screen, or front panel, an electron gun disposed in the CRT's neck portion has a plurality of aligned electrodes, including a charged shield cup. The shield cup includes a plurality of contact springs disposed about the outer periphery thereof and engaging a conductive layer on the inner surface of the CRT's neck portion for supporting the electron gun and charging the shield cup to an electron accelerating, or anode, voltage. Also disposed on the outer periphery of the shield cup and engaging the inner conductive layer is a getter support member. To provide a zero resultant force applied to the shield cup by the three contact springs and the getter support member and maintain the electron gun coaxial with the CRT's centerline, the thickness or strength of the contact springs is established such that the resultant force of the contact springs on the shield cup provides a reaction force to, and compensates for, the force exerted by the getter support member on the shield cup.

16 Claims, 2 Drawing Sheets

Fig. 3
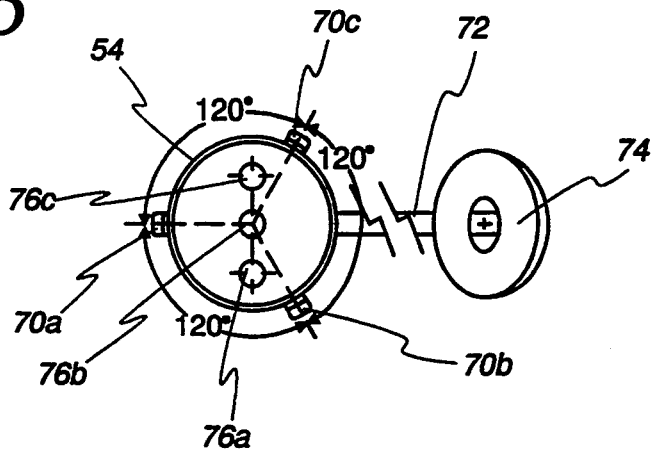
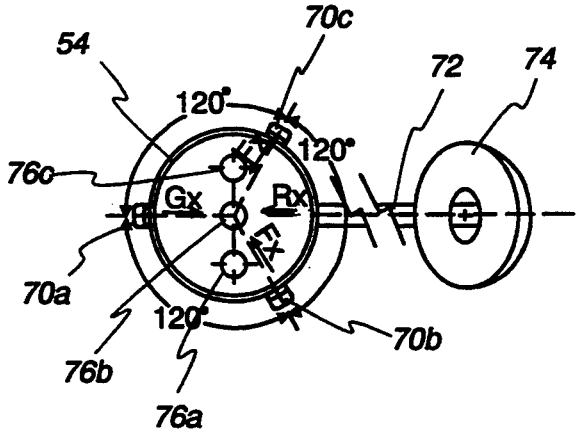
Fig. 4
Fig. 5
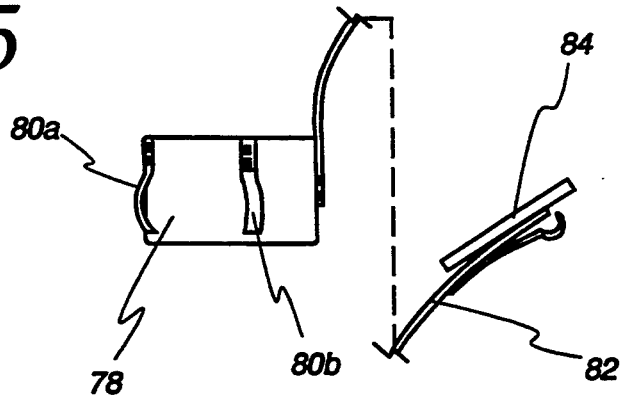

ELECTRON GUN SUPPORT AND POSITIONING ARRANGEMENT IN A CRT

FIELD OF THE INVENTION

This invention relates generally to a cathode ray tube (CRT) incorporating an electron gun and is particularly directed to an electron gun support and positioning arrangement within the glass envelope of a CRT.

BACKGROUND OF THE INVENTION

This invention relates to the support and positioning of an electron gun assembly in a CRT which includes an antenna-type getter support.

Referring to FIG. 1, there is shown a partially cutaway lateral view of a prior art CRT 8. CRT 8 includes a glass envelope, or bulb, 10 including a front panel, or display screen, 11, a narrow neck portion 13, and a funnel portion 12 disposed intermediate the front panel and neck portion. Disposed on the inner surface of the CRT's front panel 11 is a phosphor screen 24. Disposed within the CRT's neck portion 13 is a multi-electrode electron gun 15 directing one or more electron beams onto the phosphor screen 24 on the inner surface of the front panel 11. The CRT's glass envelope 10 is evacuated and is sealed where the front panel 11 joins the funnel portion 12 and at the distal end of the neck portion 13 of the CRT. The electron gun 15 includes a stem 14, an end electrode termed the shield, or convergence, cup 17, and a plurality of aligned charged electrodes disposed intermediate the stem and the shield cup which are not shown in the Figure for simplicity. Disposed about in a spaced manner and engaging the shield cup 17 are a plurality of contact springs, or bulb spacers, 18 which engage a conductive graphite coating 21 on the inner surface of the CRT's glass envelope for maintaining the electron gun 15 in position within the neck portion 13 of the CRT. The electron gun's cathode(s) heater and charged electrodes are attached to and maintained in common alignment by means of a plurality of elongated glass beads 16.

The CRT's antenna-type getter assembly includes a getter element 20 and a getter support member 19 disposed on the inner surface of the CRT's glass envelope 10. The getter support 19 is in electrical contact with the electron gun's shield cup 17 and extends to an intermediate portion of the CRT's funnel portion 12 and terminates in the getter element 20. A getter flashing process is performed by inductive heating of the getter element 20 by means of a high frequency (HF) coil (not shown for simplicity) placed outside the wall of the glass envelope 10 and adjacent to the getter element. The electromagnetic field generated by the HF coil penetrates the glass envelope 10, inducing a current in the getter element 20 in accordance with the Faraday-Lenz Law for absorbing residual gases during CRT manufacture.

The metallic shield cup 17 functions as a charged electrode in electron gun 15. Shield cup 17 is maintained at the anode voltage and is coupled to an anode button 22 extending through the funnel portion 12 of the glass envelope 10 by means of the combination of a graphite coating 21 disposed on an inner wall of the glass envelope and the aforementioned contact springs 18. An outer graphite coating 23 disposed on the funnel portion 12 of the glass envelope 10 forms a capacitance with the inner graphite coating 21.

In the prior art CRT 8 shown in FIG. 1, the contact springs 18 are typically three in number and are equally spaced at 120° intervals about the shield cup 17. If the electron gun 15 does not include a shield cup-mounted getter support, the center axis of electron gun 15 is easily aligned with the glass envelope's centerline 32 (shown in dotted line form). However, in a CRT incorporating a getter support member 19 attached to the electron gun's shield cup 17, the resultant force of the contact springs 18 and the getter support member on the shield cup is not zero, causing misalignment between the electron gun axis and the CRT's centerline. As a result, the electron beam(s) will not be incident on the center of the front panel 11 when the beams are undeflected giving rise to misregistration of the electron beam(s) with the phosphor elements on the front panel 11 and apertures in a shadow mask, or color selection electrode (which also is not shown), in a color CRT. This electron gun misalignment and electron beam misregistration degrades video image resolution and color purity. One prior art approach to correct this problem involves the asymmetric positioning of three contact springs about the shield cup to compensate for the force of the getter support member. Precisely positioning the contact springs asymmetrically about the shield cup is difficult, limiting the usefulness of this approach.

The present invention addresses the aforementioned limitations of the prior art by providing an electron gun support and positioning arrangement which maintains the electron gun coaxially aligned with the CRT's centerline by supporting the electron gun's shield cup with a plurality of spaced contact springs which apply a resultant force on the shield cup which cancels out the force exerted on the shield cup by a getter support member.

OBJECTS AND SUMMARY OF THE INVENTION

Accordingly, it is an object of the present invention to provide for the more secure positioning and precise alignment of an electron gun on the centerline of a CRT during CRT assembly.

It is another object of the present invention to provide a support and positioning arrangement for more accurately locating an electron gun on the longitudinal axis of a CRT.

Yet another object of the present invention is to provide a contact spring arrangement disposed about and engaging the shield cup of an electron gun which compensates for a getter support member also engaging the shield cup for centering the electron gun and its associated electron beam(s) on the center axis of a CRT.

A further object of the present invention is to position an electron gun having a plurality of spaced contact springs and a getter support member in the neck of a CRT glass envelope coaxially with the envelope's center axis.

The present invention contemplates a plurality of contact springs disposed about and engaging the shield cup of an electron gun within the neck portion of a CRT glass envelope. The electron gun's shield cup also engages a getter support member attached to an inner surface of the CRT's glass envelope. The contact springs are provided with a selected thickness or strength to compensate for the force exerted on the shield cup by the getter support member. The characteristics of the contact springs are selected such that the total force applied to the shield cup, including the force applied by the getter support member, is zero in a direction perpendicular to the center axis of the glass envelope. In this manner, the electron gun is securely maintained in position coaxially in line with the CRT's center line for more accurate positioning of the electron beam(s) on the CRT's front panel.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 3 is an end-on view of the electron gun of FIG. 2, illustrating details of the electron gun's shield cup and a getter electrically coupled thereto;

FIG. 4 is an end-on view of an electron gun support and positioning arrangement in accordance with the principles of the present invention; and FIG. 5 is a side elevation view of the electron gun shield cup and getter combination shown in FIG. 4.

DETAILED DESCRIPTION OF THE PREFERRED EMBODIMENTS

Figure 2:
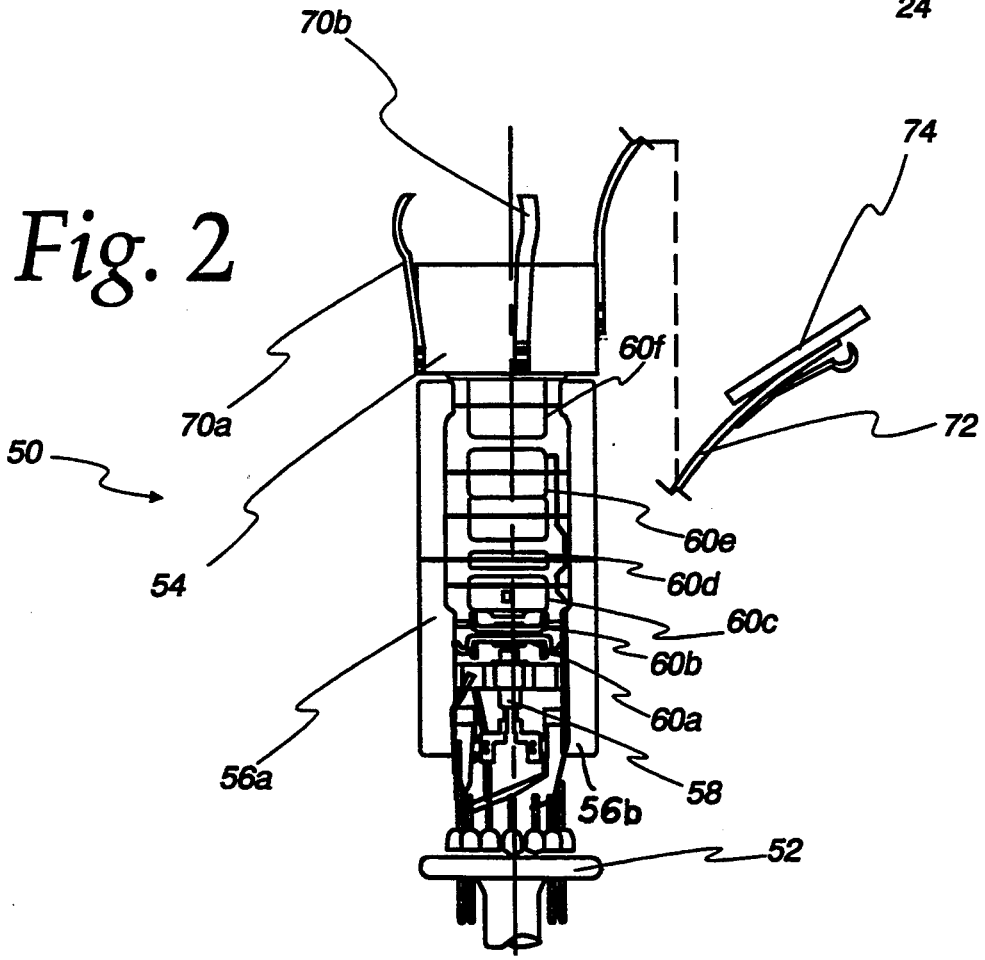
FIG. 2 is a side elevation view of an electron gun with a support and positioning arrangement in accordance with the present invention.

Referring to FIG. 2, there is shown a side elevation view of an electron gun 50 having a support and positioning arrangement in accordance with the present invention. Electron gun 50 includes a stem 52 at a first end and a shield, or convergence, cup 54 at a second, opposed end. Disposed intermediate stem 52 and shield cup 54 and arranged in a generally linear array is a cathode 58 (or a plurality of cathodes in a color CRT) and a plurality of charged electrodes 60a–60f. Cathode 58 and electrodes 60a–60f are attached to and maintained in linear alignment by means of a pair of glass beads 56a and 56b. Glass beads 56a, 56b are linear, elongated members extending a substantial portion of the length of electron gun 50. Glass beads 56a, 56b maintain the various cathodes and electrodes in fixed relative position within the CRT's neck portion which is not shown in the figure for simplicity.

Figure 1:
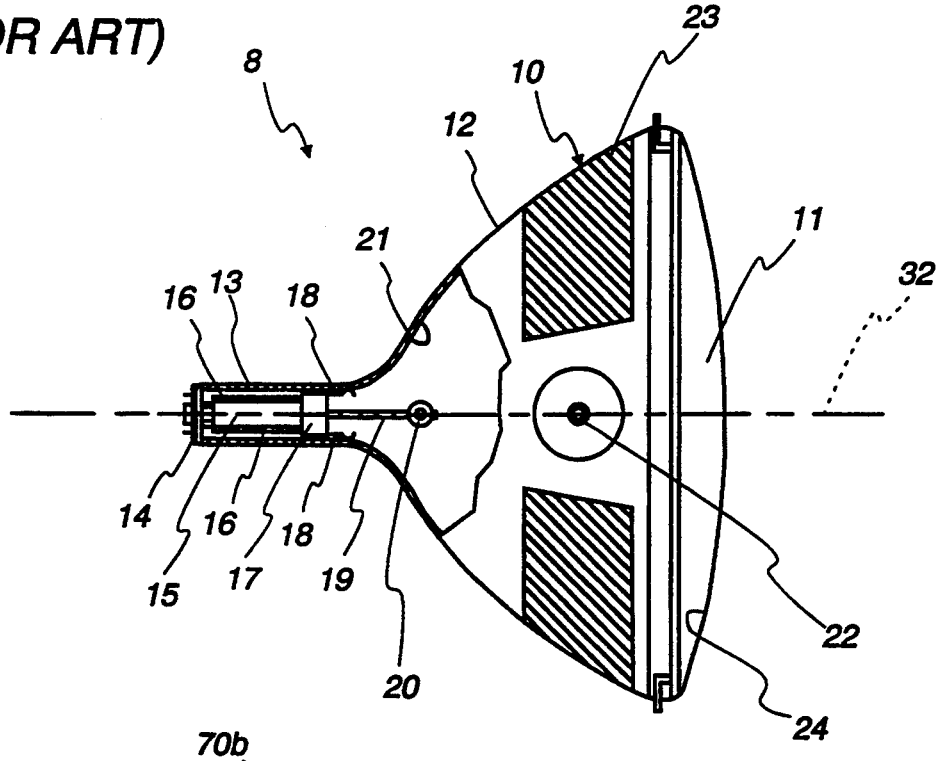
Fig. 1 (PRIOR ART)
FIG. 1 is a partially cutaway side elevation view of a prior art CRT incorporating a conventional electron gun support and positioning arrangement.

The last electrode in electron gun 50 in proceeding toward the CRT's front panel (which also is not shown for simplicity) is the shield cup 54. Attached to shield cup 54 around the outer periphery thereof are three contact springs, or bulb spacers, 70a, 70b and 70c as shown in the end-on view of the electron gun of FIG. 3. Also in contact with the outer periphery of shield cup 54 is a first end of a getter support member 72. A second, opposed end of the getter support member 72 is coupled to a getter element 74. Getter support member 72 and getter element 74 are disposed on or adjacent to the inner surface of the CRT's glass envelope as in the previously described prior art CRT of FIG. 1. In the case of a color CRT, three cathodes 76a, 76b and 76c arranged in an inline array are disposed in electron gun 50 as shown in FIG. 3. Also as in prior art CRT's, the three contact springs 70a, 70b and 70c are symmetrically disposed about the longitudinal axis, or centerline, of the electron gun, with 120° between adjacent contact springs also as shown in FIG. 3.

Additional details of an electron gun support and positioning arrangement in a CRT in accordance with the present invention are shown in FIG. 4. As shown in FIG. 4, the getter support member 72 is disposed midway between contact springs 70b and 70c. Thus, the angle between the getter support member 72 and contact spring 70b is equal to the angle between the getter support member and contact spring 70c, with the angle between the getter support member and each of the two aforementioned contact springs being 60° in the case illustrated. Getter support member 72 is diametrically disposed relative to contact spring 70a.

As shown by the direction of the arrows in FIG. 4, contact springs 70b and 70c exert a radially inward force of $F_x$ on shield cup 54. Similarly, contact spring 70a exerts a radially inward directed force $G_x$ on shield cup 54. Finally, getter support member 72 exerts a radial, inwardly directed force of $R_x$ on shield cup 54.

In accordance with the present invention, the radially inwardly directed force $G_x$ exerted by contact spring 70a on shield cup 54 is given by the following:

$$G_x = 2F_x(\cos 60°) + R_x$$

where $F_x$ = force of each of the contact springs adjacent to the getter support member on the shield cup; and $R_x$ = force of getter support member on shield cup.

Thus, contact springs 70b and 70c exert essentially the same force $F_x$ on the shield cup 54, while contact spring 70a exerts a greater force on the shield cup to compensate for the inwardly directed force of the getter support member 72. The difference in the inwardly directed forces of contact spring 70a and contact springs 70b and 70c may be provided by either increasing the thickness or strength of contact spring 70a over that of the other two contact springs. For example, in a CRT neck having a diameter of 29 mm, the required thickness of contact spring 70a is on the order of 0.25 mm, where the thickness of the two remaining contact springs is on the order of 0.18 mm, to compensate for the inwardly directed force of the getter support member 72. With the getter support member force thus compensated for, electron gun 50 will be coaxially aligned with the CRT's centerline and an electron beam emitted by the electron gun will be incident upon the center of the CRT's phosphor screen.

The other approach employs contact springs having essentially the same thickness, but with different compositions and strengths. Thus, in this approach contact springs 70b and 70c have a first composition and exhibit a first strength value, while contact spring 70a has a second composition and exhibits a second, greater strength value. Various materials well-known to those skilled in the relevant arts could be used for these contact springs having different strengths. By selecting a material having a given Young's Modulus, the strength of contact spring 70a and its associated force $G_x$ may be matched with the strengths of contact springs 70b and 70c, as well as that of the getter support member 72 and their respective radially inwardly directed forces $F_x$ and $R_x$ to provide a zero (0) resultant force on shield cup 54. In this manner, shield cup 54 and electron gun 50 are maintained coaxially aligned with the CRT's centerline, or longitudinal axis.

In the electron gun 50 described thus far, the contact springs 70a, 70b and 70c attached to shield cup 54 are attached to the bottom, or cathode facing end, of the shield cup and extend toward the CRT's front panel. Referring to FIG. 5, there is shown another embodiment of an electron gun support and positioning arrangement in accordance with the present invention. In the embodiment shown in FIG. 5, contact springs 80*a* and 80*b* (as well as the third contact spring which is not shown in the figure for simplicity) are attached to an upper portion of shield cup 78 and extend toward the electron gun's cathode (also not shown). Thus, contact springs 80*a*, 80*b* are attached to shield cup 78 adjacent an edge in facing relation to the CRT's front panel. Also shown in FIG. 5 is a getter support member 82 attached to an outer, lateral portion of the shield cup 78 at one end thereof and also attached to a getter element 84 at a second opposed end thereof as in the previously described embodiment.

In the embodiment where the three contact springs have the same composition but different thicknesses, the three contact springs are preferably comprised of INCONEL 600 having the following composition in percentage weight: C-0.15% (maximum); Si-0.50% (maximum); S-0.015% (maximum); Fe-5.0 to 7.5%; Mn-1.0% (maximum); Cr-15.0 to 18.0%; with Ni comprising the balance of the composition.

In the embodiment where the contact springs have different compositions, two of the contact springs may be comprised of aluminum alloy 2024 having an elasticity modulus of $11\times10^6$ psi, while the third contact spring may be comprised of INCONEL 600 having an elasticity modulus of $30\times10^6$ psi.

There has thus been shown an improved arrangement for supporting and positioning an electron gun in a CRT employing three contact springs symmetrically disposed about and engaging in outer periphery of a shield cup electrode of the electron gun. Also engaging in outer periphery of the electron gun's shield cup is a getter support member. The three contact springs provide support for the top end of the electron gun and couple the shield cup to the CRT's anode voltage. The getter support member is disposed intermediate first and second contact springs and is equally displaced from each. The third contact spring is diametrically disposed relative to the getter support member on the shield cup and provides a greater inwardly directed force on the shield cup than that exerted by the first and second contact springs. The symmetrically disposed contact spring arrangement with asymmetrically applied forces on the shield cup compensates for the inwardly directed force of the getter support member on the shield cup to ensure coaxial positioning of the electron gun on the CRT's centerline. The differential, inwardly directed forces exerted by the contact springs upon the shield cup are produced either by varying the thickness or strength of the contact springs.

While particular embodiments of the present invention have been shown and described, it will be obvious to those skilled in the art that changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use in a cathode ray tube having an evacuated glass envelope with a conductive layer disposed on an inner surface of said glass envelope and a getter element engaging said conductive layer, an arrangement for electrical coupling to and supporting an electron gun within a neck portion of said cathode ray tube, said arrangement comprising:

a generally cylindrical, hollow shield cup disposed on an end of the electron gun within the neck portion of the cathode ray tube;

a getter support member engaging an outer, peripheral portion of said shield cup and coupled to the getter element for supporting the getter element; and first, second and third contact springs engaging the conductive layer on the inner surface of the glass envelope and an outer periphery of said shield cup, wherein said contact springs are symmetrically disposed in a spaced manner about said shield cup with said first and second contact springs disposed in an equally spaced manner on respective sides of said getter support member and said third contact spring diametrically disposed on said shield cup with respect to said getter support member, and wherein said third contact spring exerts a greater inwardly directed force on said shield cup than inwardly directed forces exerted by said first and second contact springs on said shield cup in compensating for an inwardly directed force exerted by said getter support member on said shield cup and maintaining said electron gun in coaxial alignment with a centerline of the glass envelope.

2. The arrangement of claim 1 wherein said first and second contact springs each exert an inwardly directed force $F_x$ on said shield cup and said getter support member exerts an inwardly directed force $R_x$ on said shield cup, and wherein said third contact spring exerts an inwardly directed force in $G_x$ on said shield cup, where $G_x=2F_x(\cos 60°)+R_x$.

3. The arrangement of claim 2 wherein said first, second and third contact springs each have the same composition, and wherein said third contact spring is thicker than said first and second contact springs.

4. The arrangement of claim 3 wherein each of said contact springs is comprised of INCONEL 600.

5. The arrangement of claim 4 wherein the neck portion of the cathode ray tube has an inner diameter of 29 mm, and wherein the thickness of said third contact spring is 0.25 mm and the thickness of said first and second contact springs is 0.18 mm.

6. The arrangement of claim 2 wherein said third contact spring is comprised of a material having greater strength than that of said first and second contact springs.

7. The arrangement of claim 6 wherein said first and second contact springs are comprised of aluminum alloy 2024 and said third contact spring is comprised of INCONEL 600.

8. The arrangement of claim 1 wherein said contact springs and said getter support member are spot welded to said shield cup.

9. The arrangement of claim 1 wherein each of said contact springs is attached to said shield cup adjacent an edge of said shield cup, and wherein said edge is proximately disposed relative to a cathode of the electron gun.

10. The arrangement of claim 1 wherein each of said contact springs is attached to said shield cup adjacent an edge of said shield cup, and wherein said edge is distally disposed relative to a cathode of the electron gun.

11. In a cathode ray tube including an electron gun disposed in an evacuated glass envelope having a longitudinal axis, said electron gun including a charged shield cup electrode and said glass envelope including a conductive layer disposed on an inner surface thereof and further including a neck portion, a front panel and a funnel portion disposed intermediate and coupled to said neck portion and to said front panel, wherein said shield cup electrode is hollow and cylindrical in shape and is disposed within the neck portion of said glass envelope, said cathode ray tube further including, in combination, a getter element and a getter support member disposed within the glass envelope, wherein said getter element engages said conductive layer on the inner surface of said glass envelope and said getter support member engages and exerts an inwardly directed, radial force on said shield cup electrode, the improvement comprising:

a plurality of contact springs symmetrically disposed about and engaging an outer periphery of said shield cup electrode for applying an unsymmetrical resultant force on said shield cup electrode, wherein said resultant force is equal in magnitude and opposite in direction to the inwardly directed, radial force exerted by said getter support member on said shield cup electrode for maintaining said electron gun in coaxial alignment with the longitudinal axis of said glass envelope, wherein said plurality of contact springs includes three contact springs symmetrically disposed at 120° intervals about and engaging said shield cup electrode, and wherein said getter support member is disposed intermediate two of said contact springs and is equally spaced from each of said two of said contact springs.

12. The improvement of claim 11 including first, second and third contact springs, and wherein said getter support member is disposed intermediate said first and second contact springs and is diametrically disposed relative to said third contact spring on said shield cup electrode.

13. The improvement of claim 12 wherein said third contact spring is thicker than said first and second contact springs.

14. The improvement of claim 13 wherein each of said contact springs is comprised of INCONEL 600.

15. The improvement of claim 12 wherein said third contact is comprised of a material having a higher strength than that of said first and second contact springs.

16. The improvement of claim 15 wherein said first and second contact springs are comprised of aluminum alloy 2024 and siad third contact spring is comprised of INCONEL 600.

* * * * *